United States Patent [19]

Manchester

[11] 4,329,003

[45] May 11, 1982

[54] CABINET-SUSPENSION SYSTEM

[75] Inventor: Robert L. Manchester, Bellair, Mich.

[73] Assignee: Interflow Systems Corporation, Grand Haven, Mich.

[21] Appl. No.: 104,436

[22] Filed: Dec. 17, 1979

[51] Int. Cl.[3] ..... A47B 67/02; A47B 96/06; F16M 13/00

[52] U.S. Cl. ..... 312/245; 312/111; 312/263; 248/225.2; 108/152

[58] Field of Search ..... 312/245, 204, 107, 111, 312/224, 225, 263; 108/152; 248/225.2

[56] References Cited

U.S. PATENT DOCUMENTS

| | | | |
|---|---|---|---|
| 2,001,324 | 5/1935 | Early | 312/245 |
| 2,884,296 | 4/1959 | Meilinger | 312/263 |
| 3,138,414 | 6/1964 | LaPollo | 312/245 |
| 3,669,035 | 6/1972 | Grossman | 108/152 |
| 3,899,228 | 8/1975 | Schreiber | 312/245 |
| 3,908,831 | 9/1975 | Brendgord | 312/245 |
| 3,950,049 | 4/1976 | Drass | 312/245 |
| 4,047,773 | 9/1977 | Semany | 312/111 |
| 4,165,852 | 8/1979 | Chervenak | 312/245 |

FOREIGN PATENT DOCUMENTS

| | | | |
|---|---|---|---|
| 2328429 | 6/1977 | France | 248/225.2 |
| 1480732 | 7/1977 | United Kingdom | 312/245 |

*Primary Examiner*—Victor N. Sakran
*Attorney, Agent, or Firm*—Glenn B. Morse

[57] ABSTRACT

An elongated rail having a cross-section with hook-shaped shelf projections, and adapted for extrusion, is secured to a wall by fastenings and adhesive for transfer of stresses to the stud structure of the wall. The rail has a substantial back portion providing a surface for receiving the adhesive, and for establishing a substantial moment of inertia in bending. Short pieces of the same rail section are secured to the back of the cabinet units in inverted position with respect to the wall rail for hooked interengagement. An abutment is interposed between the bottom of the cabinet units and the wall to maintain the vertical alignment of the cabinet units in selected positions along the wall.

1 Claim, 4 Drawing Figures

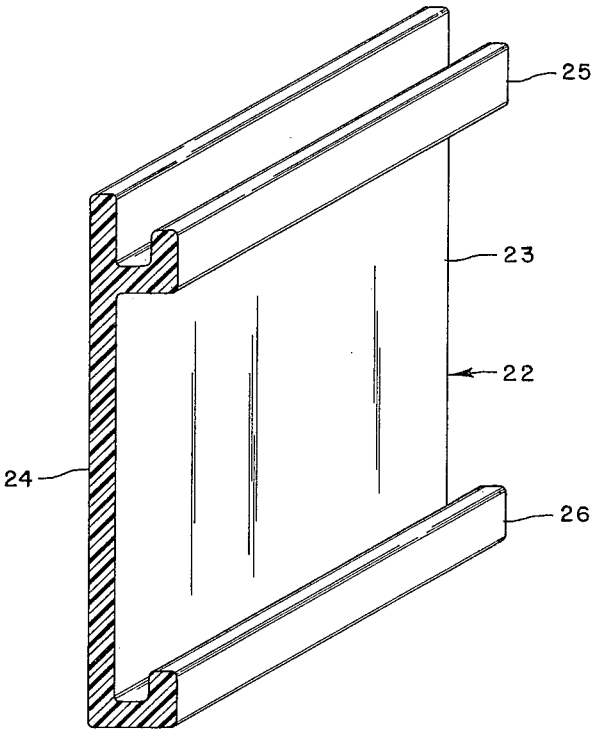
FIG. 4
FIG. 3
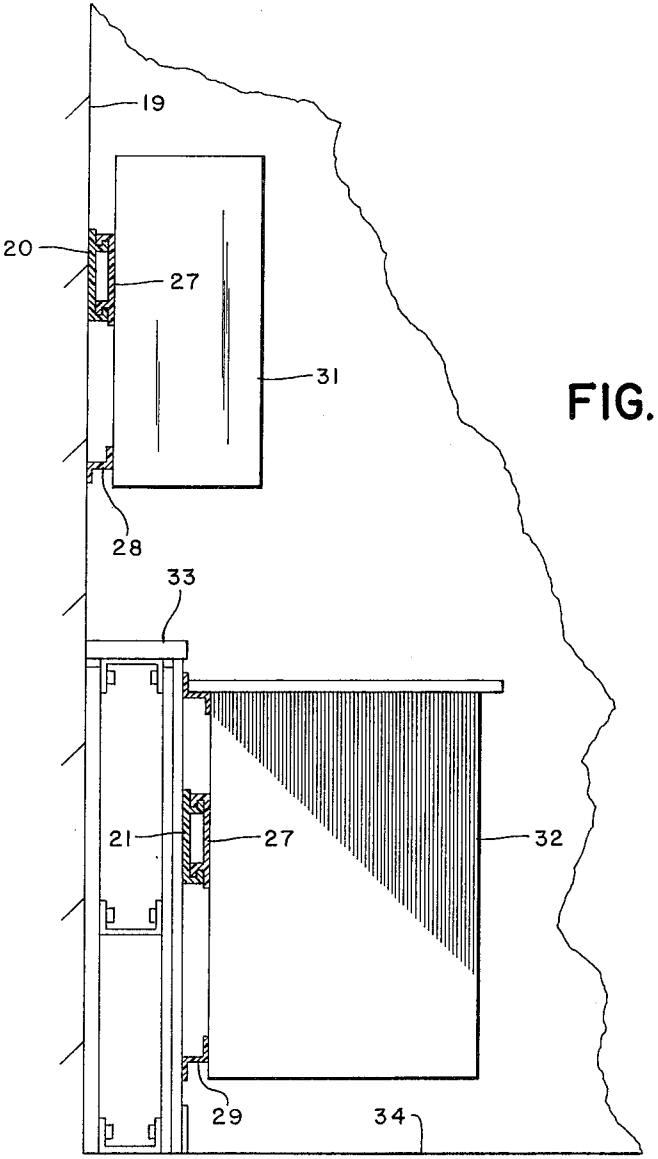

CABINET-SUSPENSION SYSTEM

BACKGROUND OF THE INVENTION

Standard prefabricated cabinet units are widely used in laboratories and kitchens, primarily because of the economy over on-site construction. These units are usually supported on the floor, and secured in place as a more or less permanent installation. Structures of this type have also been suspended from a wall, particularly in situations where the space below the cabinet unit is to be used either for storage or as counter space. The suspension of the cabinet units, particularly in view of the possibility that considerable weight may be involved, normally requires that heavy fastenings be engaged with the studs of the wall structure. The gypsum panelling of ordinary dry wall construction provides no substantial degree of strength, which dictates the location and utilization of the studs as support points. Obviously, this problem tends to dictate the position of the cabinet units, unless elaborate structural arrangements are made on-site. Proper horizontal continuity of a sequence of cabinet units is thus rather difficult to establish and maintain.

SUMMARY OF THE INVENTION

Cabinet units are suspended at selected positions along a rail secured to a wall peferably by both adhesive and auxiliary fastenings which engage the studs of a conventional wall structure. The rail has hooked-shaped projecting shelves extending parallel to its length, and is thus adapted for manufacture by extrusion processes in either metal or plastic. The backs of the cabinet units are provided with short pieces of the same rail section installed in inverted position with respect to the wall rail for hooked interengagement. An abutment, preferably mounted on the lower part of the back of the cabinet units, maintains the vertical alignment. The system provides a simple hook-on installation, replaceability of the units, and the freedom to select the position of the units along the wall. The beam function of the wall rail transfers stresses to the studs to provide the lateral freedom to position the cabinet units as may be desired.

DESCRIPTION OF THE DRAWINGS

FIG. 3 is a sectional elevation showing the installation of two cabinet units on a wall.

FIG. 4 is an enlarged perspective view showing the cross section of the rail used both on the wall and on the back of the cabinet units.

DESCRIPTION OF THE PREFERRED EMBODIMENTS

Figure 1:
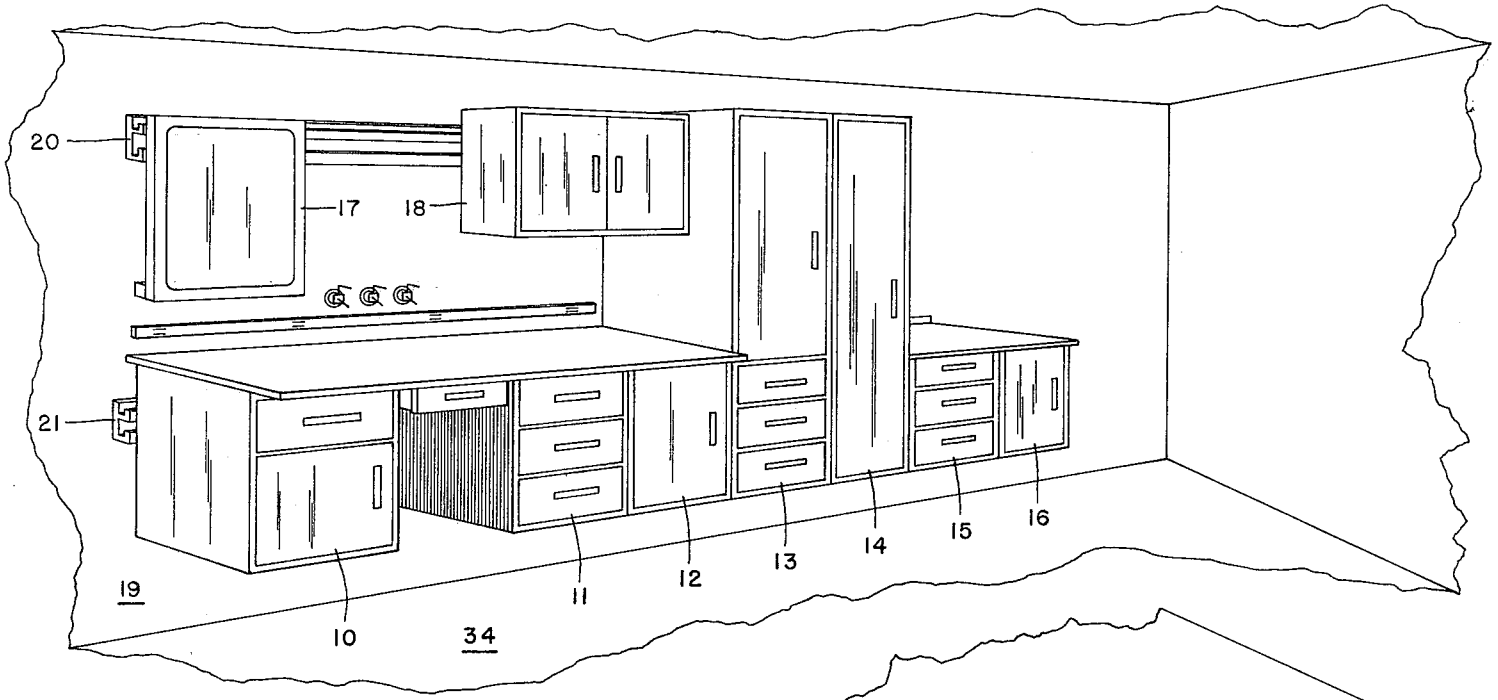
FIG. 1 is a perspective view showing a typical installation of cabinet units in a laboratory according to the present invention.

Referring to FIG. 1, the cabinet units 10–18 are shown suspended from the wall 19 by the rails 20 and 21. The cross-section of these rails is identical, and is illustrated in FIG. 4. The rail is generally indicated at 22, and has a back portion 23 providing a planar mounting surface 24 normally adhesively secured to the wall

19. It is usually desirable to run fastenings through the back portion 23 to engage the studs of the wall structure, primarily to hold the rail in the desired place during the curing of the adhesive. These fastenings may be nails or screws, and the back portion 23 mah be pre-drilled to receive these fastenings. The preferred rail material is an extrudable plastic of any common description, and the ordinary softness of this material will make it possible to drive nails directly through it without pre-drilling.

Figure 2:
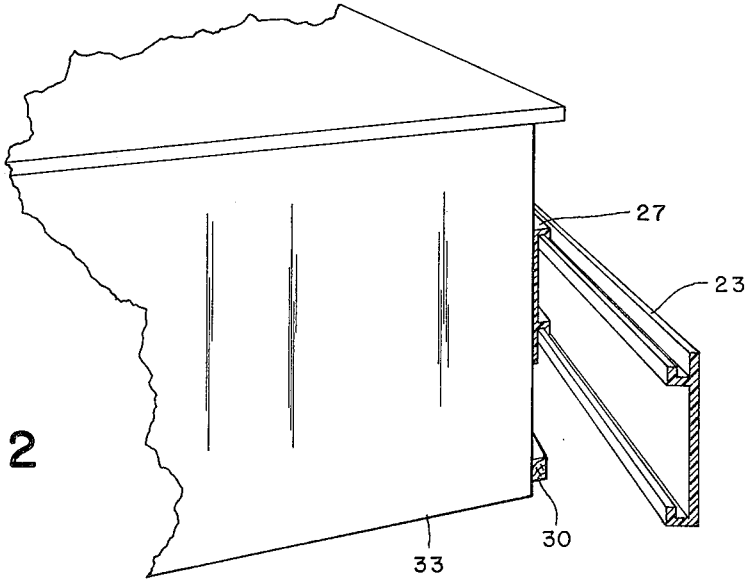
FIG. 2 is a fragmentary sectional elevation showing the interengagement of the wall rail and the cabinet rail section in hooked interengagement.

The elongated rail 22 has the hook-shaped projecting shelves 25 and 26, and these are interengagable with short pieces of the same rail cross-section installed on the backs of the cabinet units in inverted position with respect to the wall-mounted rail, as indicated in FIG. 2. The cabinet rail pieces are indicated at 27 in FIG. 2. Each of the cabinet units is preferably suspended from one rail, with the vertical alignment being maintained by an abutment member interposed between the wall and the lower part of the cabinet unit as indicated at 28 and 29 in FIG. 3. These abutment members are preferably secured to the bottom of the cabinet unit, and may be short pieces of extruded section, as shown in FIG. 3, or blocks of wood as indicated at 30 in FIG. 2. These abutment members maintain the vertical alignment of the cabinet units generally indicated at 31 and 32 in FIG. 3, and at 33 in FIG. 2.

Applicants have found that an adhesive marketed under the designation of Number 732 Dow-Corning Adhesive has been very satisfactory to bond the back surfaces 24 of the wall rails to the surface of a wall. Screw-type fasteners are preferable traversing the back 23 of the rail sections, and engaging the studs of the wall structure. As shown, in FIG. 3, it is also possible to suspend the cabinet units from auxiliary wall structure as shown at 33, which may be provided in particular cases for auxiliary counter top surface, or to provide space for the installation of concealed conduits of various types. In the usual installation, the cabinets will be supported in spaced relationship above the floor 34.

I claim:

1. In combination with a cabinet unit and a wall structure, a mounting means system having identical rail members for supporting said cabinet unit comprising:

an elongated rail at least the width of said cabinet secured to said wall structure, said rail having a cross-sectional configuration including a planar back portion, a first upwardly-turned hook portion spaced from the edge of said back portion and extending from said back portion, a second upwardly-turned hook portion, said second hook portion spaced downward from said first hook portion and extending from said back portion;

a short rail which is less than the width of said cabinet of identical cross section to that of said elongated rail, said short rail being secured to the upper back portion of said cabinet unit in inverted position with respect to said elongated rail, whereby said hook portions are interengageable in a direction perpendicular to said back portion; and a bearing abutment interposed between, and secured to one of, the lower back portion of said cabinet unit and said wall structure to maintain vertical alignment of said cabinet unit and wall structure.

* * * * *